United States Patent [19]

Jasper

[11] 4,053,052

[45] Oct. 11, 1977

[54] PACKAGED ADDITIVE CAP

[75] Inventor: Mark Friedel Jasper, Laguna Hills, Calif.

[73] Assignee: American Hospital Supply Corporation, Evanston, Ill.

[21] Appl. No.: 766,859

[22] Filed: Feb. 9, 1977

[51] Int. Cl.[2] ..... B65D 85/70

[52] U.S. Cl. ..... 206/439

[58] Field of Search ..... 206/439, 445, 484, 498, 206/820; 215/232

[56] References Cited

U.S. PATENT DOCUMENTS 3,770,119 11/1973 Hultberg et al. ..... 206/439

3,991,881 11/1976 Augurt ..... 206/439

*Primary Examiner*—George T. Hall

*Attorney, Agent, or Firm*—Tilton, Fallon, Lungmus, Chestnut & Hill

[57] ABSTRACT

A packaged additive cap adapted for use with containers for parenteral solutions and the like including a continuous side wall, a top, a continuous flange, and a removable backing sheet. The top is integral with the side wall at the upper extremity thereof and the flange is integral with the side wall at the lower extremity thereof. The backing sheet is removably sealed to the underside of the flange to maintain the interior of the cap in sterile condition for use.

7 Claims, 4 Drawing Figures

PACKAGED ADDITIVE CAP

BACKGROUND

The present invention relates to a cap and more particularly to a packaged additive cap adapted for use with containers for parenteral solutions and the like.

It is a common medical practice to introduce an additive, such as a prescribed medicament, to sterile medical solutions intended for intravenous feeding or for surgical irrigation. In such a case, the original protective outer closure of the solution container is removed, the piercable diaphragm of the inner closure is exposed, and the sterile additive solution is injected through the diaphragm to mix with the original liquid contents of the container. Since the additives are normally introduced into the containers at locations remote from those where the solutions are to be administered or used, and since a substantial time lapse may occur between introduction of an additive and use of the modified solution, sound medical practice requires that a new protective outer cap, commonly referred to as an additive cap, be placed over the inner closure immediately following introduction of the additive. Such an additive cap not only protects the inner closure against contamination prior to use or administration of the modified solution, but also indicates, usually by means of distinctive colorations of the additive cap, that the contents of the container have in fact been modified.

One problem in the use of sterile additive caps has been the risk of contaminating the inner surface portions thereof during removal of the caps from their wrappers or packages. Such a package has often taken the form of a dome-shaped thermoplastic bubble which receives the cap, the bubble being closed by a removable backing sheet. The entire cap within the bubble package is in a sterile condition prior to removal of the cap; however, users have sometimes experienced difficulty in removing such a cap from its package without contaminating that cap and, in particular, without touching and thereby contaminating the inner surfaces thereof. It should be noted that the outer surfaces of the bubble and backing sheet are presumed non-sterile. Consequently, finger contact with such surfaces, necessary for the purpose of opening the package in the first instance, would result in subsequent contamination of any surfaces of the cap later touched by the user while attempting to extract the cap from the opened package, even if the user took the extra precaution of putting on sterile gloves before undertaking such an operation.

Despite the need for improved packaging of sterile additive caps, bubble packages for such caps are still widely used and no completely effective substitute has heretofore been found. Packaging as commonly used in the medical field is generally illustrated in U.S. Pat. No. 3,630,346. The packaging heretofore used in various other fields is generally disclosed in U.S. Pat. Nos. 3,715,856, 3,192,091, and 3,394,869. The present invention represents a distinct improvement in the recognition of the problems associated with separately packaged sterile caps as well as the provision of a simple, improved structure of novel configuration which overcomes such problems in their entirety.

SUMMARY

The present invention provides an improved separately packaged sterile additive cap which is relatively simple and inexpensive, is easily used, and is particularly well adapted for use with containers for parenteral solutions and the like. The packaged additive cap includes a continuous side wall, a top, a continuous flange and a backing sheet. The top is integral with the side wall at the upper extremity thereof and the flange is integral with the side wall at the lower extremity thereof. The flange, top and side wall define the exterior surfaces and the sterile interior surfaces of the cap. The backing sheet is removably secured to the underside of the flange and maintains the cap's interior surfaces in sterile condition prior to use.

In the disclosed embodiment, the backing sheet is heat sealed to the underside of the flange. Once removed, the backing sheet will not re-adhere to the flange, at least at room temperatures, thereby virtually eliminating any possibility that a user might inadvertently open a package that had previously been opened and then resealed. To facilitate sterilization, the backing sheet should be formed of a microporous material capable of permitting the passage of sterilizing gases while at the same time blocking the passage of microorganisms.

The cap package of this invention therefore retains the advantages inherent in individually-packaged sterile caps while overcoming the disadvantages associated with the cumbersome packaging heretofore used with such caps. The invention completely eliminates the need for use of a sealed thermoplastic bubble, or other means for totally enveloping a cap, and includes, as part of that invention, the recognition that only the interior surfaces of the cap need be sterile. The exterior surface portions of the packaged additive cap therefore perform multiple functions, some of which have been performed in the past only by additional packaging means in the form of wrappers, bubble packages, or other cap-enveloping means.

It is therefore an object of the present invention to provide a sterile additive cap adapted for use with containers for parenteral solutions and the like with simplified packaging to more completely assure maintaining the interior surfaces sterile prior to use of the cap. The provision of the structure and the realization of the advantages to be derived therefrom constitute additional important objects of this invention. Other objects of the present invention can be appreciated from the details of construction and operation set forth in the accompanying specification, claims, and drawings.

DRAWINGS

The invention is described in conjunction with the accompanying drawings, in which.

DESCRIPTION

Figure 2:
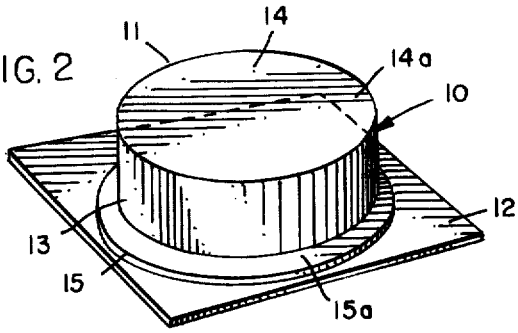
FIG. 2 is a perspective view of the additive cap with the backing sheet attached to the underside of the flange.
Figure 3:
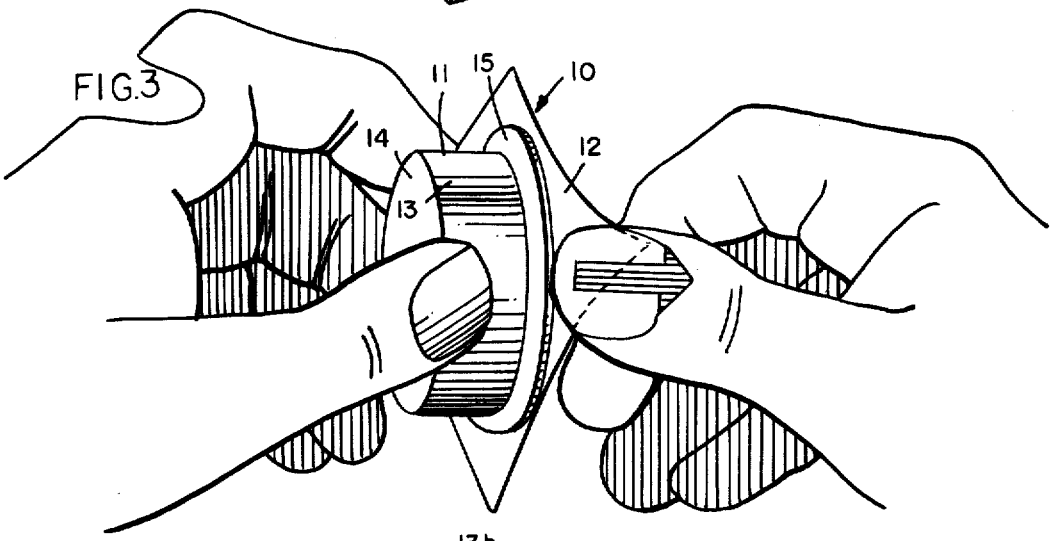
FIG. 3 is a perspective view of the additive cap with the backing sheet being removed from the underside of the flange.
Figure 4:
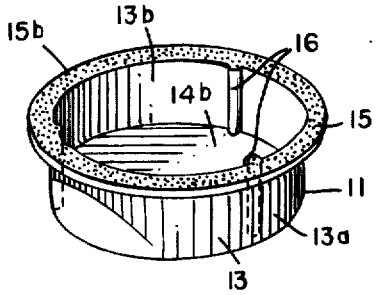
FIG. 4 is a perspective view of the additive cap with the backing sheet removed from the underside of the flange showing the interior surfaces of the cap.

In the illustration given, and with reference first to FIG. 2, the numeral 10 generally designates a packaged additive cap in accordance with the present invention.

The packaged additive cap 10 includes cap 11 and a removable backing sheet 12. As shown, cap 11 has a continuous side wall 13, an integral top wall 14, and an integral flange 15 which extends continuously about the side wall at the lower end thereof and which projects radially outwardly from that side wall.

The exterior surfaces of the cap 11 include outer surfaces 13*a* and 14*a* of the side and top walls, respectively, and the upper surface 15*a* of the flange. The interior surfaces of the cap 11 are the inner surfaces 13*b* and 14*b* of the side and top walls, respectively, and the underside 15*b* of flange 15. All of the interior surfaces are sterilized prior to use of the cap as a bottle closure. Such sterilization may occur during production, or it may be effected and/or augmented following the sealing of the backing sheet 12 to flange 15 as hereinafter described.

While other materials might be used in its fabrication, the cap is ideally formed of a plastic material, preferably a thermoplastic such as polyethylene, polypropylene, or an ethylene-propylene copolymer. The backing sheet is effectively formed from a sheet of microporous paper or plastic material permeable to sterilizing gases such as ethylene oxide but impermeable to microorganisms. A microporous non-woven spun-bonded polyolefin marketed under the designation Tyvek by E. I. duPont deNemours, Wilmington, Delaware, has been found particularly effective but other materials, such as spun-bonded nylon or tough microporous filter paper may also be used. Where compatible thermoplastic materials are used for both the cap and the backing sheet, the two elements may be secured together by heat sealing. Heat sealing techniques may also be used even if one or both of the elements is formed of a non-thermoplastic material as long as a thermally-activated adhesive is interposed between the parts. Thus, a tough paper backing sheet may be heat sealed to the flange of the cap if those surface portions of the sheet in contact with the flange are first coated with polyethylene or some other thermoplastic material compatible with the material of the cap.

Less effective results might be achieved by securing the backing sheet to the cap by other sealing means such as, for example, a pressure-sensitive adhesive. Heat sealing is particularly desirable because it results in a tamper-proof package; that is, the backing sheet, when separated from the cap, will not re-adhere to the cap should the parts be returned to their original positions at ordinary (room) temperatures. In any event, regardless of the means used for removably securing the backing sheet to the flange of the cap, the backing sheet must be sufficiently tough, and the bond sufficiently weak, so that the seal may be broken by peeling the backing sheet away from the cap without tearing or destroying the integrity of that sheet.

As shown in the drawings, side wall 13 of the cap is generally cylindrical in shape. The perimetric flange or brim 15 is preferably circular in configuration and is substantially smaller in outline than backing sheet 12. In the illustration given, the backing sheet is depicted as being square or rectangular in outline; however, it is to be understood that other configurations might be used. In the best mode presently known for practicing the invention, side wall 13 includes a plurality of integral internal axially-extending ribs 16 which contribute in stiffening the side wall and which frictionally cooperate with the neck of a container during use of the cap.

The cap 11 and backing sheet 12 comprise the entire packaged additive cap 10. The exterior surface of the cap, including surfaces 13*a*, 14*a*, and 15*a*, form a part of the total packaging as well as a part of cap 11. The packaged additive cap 10 therefore eliminates the need for a thermoplastic bubble or enclosure as heretofore used with separately packaged sterile caps. The interior surfaces of the cap (surfaces 13*b*, 14*b*, and 15*b*) are maintained in sterile condition prior to use by the protective backing sheet 12. The packaged additive cap 10 therefore embodies the important recognition that the exterior of the cap 11 need not be maintained in sterile condition as long as it is effectively separated from the sterile interior of the cap by a cooperating element in the form of backing sheet 12.

This recognition leads to other significant advantages of the present invention. The packaged additive cap 10, as shown in FIG. 2, may be shipped to a hospital or the like for use after the interior surfaces of the cap 11 have been sterilized and sealed with the backing sheet 12. A doctor, nurse, or other medical personnel wishing to use the cap as a closure for parenteral solution containers or the like can simply grasp the exterior surfaces 13*a* with one hand and grip an outwardly-extending portion of backing sheet 12 with the other to peel the backing sheet away from the flange. The possibility of the cap's interior surfaces being touched or otherwise contaminated by the user is virtually eliminated as a result of the ease with which the backing sheet can be removed while the cap is itself firmly gripped by its exterior surfaces. The cap package 10 therefore eliminates most common causes of contamination of the interior surfaces of individually-packaged sterile caps as such caps are being unpackaged for use.

Figure 1:
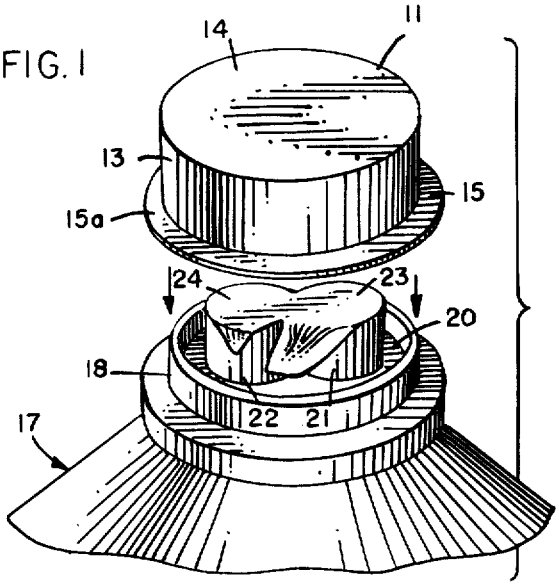
FIG. 1 is a fragmentary perspective view of a parenteral solution container receiving the additive cap with the backing sheet removed from the underside of the flange.

After removal of the backing sheet 12, cap 11 may be used as a protective closure for a container such as the parenteral solution container 17 illustrated in FIG. 1. Container 17 is provided with a neck 18, an inner closure 20, an additive tube 21, and a connecting tube 22. Tubes 21 and 22 are protected by foil tabs 23 and 24, respectively, which can be removed after detachment of the container's original outer closure (not shown), for purposes of either connecting the container to an administration set by means of connecting tube 22 or adding a medicament to the container through additive tube 21. After adding medicament to the contents of the container 17, and prior to attachment of an administration set (not shown), additive cap 11 is used as shown to protect against contamination until such time as the contents of the container are to be administered or dispensed.

The present invention therefore results in a packaged additive cap in which the cap itself comprises a major portion of the packaging. The backing sheet cooperates with the cap to maintain the interior surfaces thereof in sterile condition prior to use of the cap. While in the foregoing specification, a detailed description of an embodiment of the invention has been set forth in considerable detail for purposes of illustration, it will be understood that variations of the details herein given may be made by those skilled in the art without departing from the spirit and scope of the invention.

I claim:

1. An additive cap package consisting essentially of a cap having a continuous side wall, a top wall, and a perimetric flange projecting outwardly and continuously about the lower extremity of said side wall; said cap having sterile interior surfaces; and a backing sheet removably secured to the undersurface of said flange to seal the interior of said cap and to maintain said interior surfaces in sterile condition.

2. The package of claim 1 in which said backing sheet is heat sealed to the undersurface of said flange.

3. The package of claim 1 in which said backing sheet is substantially larger in outline than said flange.

4. The package of claim 1 in which said side wall is generally cylindrical in configuration and said flange is generally circular in outline.

5. The package of claim 1 in which said backing sheet is formed of microporous sheet material, said microporous sheet material being permeable to sterilizing gases but impermeable to the passage of microorganisms.

6. The package of claim 1 in which said cap is formed integrally of substantially rigid plastic material.

7. The package of claim 1 in which said sterile interior surfaces of said cap include said undersurface of said flange, said backing sheet having a sterile top surface facing said interior surfaces.

* * * * *